US008262339B2

(12) United States Patent
Chien

(10) Patent No.: US 8,262,339 B2
(45) Date of Patent: Sep. 11, 2012

(54) FLOW CHANNEL OF A REGENERATIVE PUMP

(76) Inventor: Huan-Jun Chien, Taipei (TW)

( * ) Notice: Subject to any disclaimer, the term of this patent is extended or adjusted under 35 U.S.C. 154(b) by 1062 days.

(21) Appl. No.: 12/192,325

(22) Filed: Aug. 15, 2008

(65) Prior Publication Data

US 2009/0047125 A1 Feb. 19, 2009

(30) Foreign Application Priority Data

Aug. 17, 2007 (CN) ..... 2007 1 0141659

(51) Int. Cl.
*F04D 1/04* (2006.01)
*F04D 5/00* (2006.01)

(52) U.S. Cl. ..... 415/55.1; 415/58.2; 415/59.1

(58) Field of Classification Search ..... 415/55.1, 415/58.2, 59.1
See application file for complete search history.

(56) References Cited

U.S. PATENT DOCUMENTS 4,678,395 A * 7/1987 Schweinfurter ..... 415/55.6
5,405,251 A * 4/1995 Sipin ..... 417/420
5,407,318 A * 4/1995 Ito et al. ..... 415/55.1
5,498,124 A * 3/1996 Ito et al. ..... 415/55.1
5,765,992 A * 6/1998 Muramatsu et al. ..... 415/55.1
6,082,960 A * 7/2000 Fandrey et al. ..... 415/55.1

* cited by examiner

*Primary Examiner* — Jarrett Stark
*Assistant Examiner* — Nicholas Tobergte
(74) *Attorney, Agent, or Firm* — McGlew and Tuttle, P.C.

(57) ABSTRACT

The present invention provides an improvement in a new structure of a regenerative pump, including a cross section structure of the flow channel of a pump casing and closed type impeller, whereby to improve a better flow model for pump performance to solve problems of noise, and to increase the outflow capacity and higher efficiency.

8 Claims, 6 Drawing Sheets

FLOW CHANNEL OF A REGENERATIVE PUMP

BACKGROUND OF THE INVENTION

The present invention provides a new structure of a regenerative pump, fluid be circulated many times by vanes inside pump casing to get higher head. The new flow model of the flow channel is based on two streamlines of flow channels, one flow channel inside pump casing and one flow channel in vanes with closed impeller, those streamline have larger radius curvature to keep flow more smoothly. One of new features of new structure of pump is the maximum width nearby the leading edge of vanes of impeller, it could enlarge the radius of curvature of the streamline both at leading edge and trailing edge, and to reduce flow disturbance also; Closed type impeller is another feature, it could reduce flow disturbance between whirl area, the central part of flow model, and impeller, and separate the whirl area at side space of shroud plate of impeller, so vanes only works down the fluid inside the flow channel, and not works down the flow at the whirl area, and keep the whirl area in lower velocity to avoid tip vortex at shroud, and the whirl area is down size also; The trailing edge at outlet diameter of impeller is a incline line is another feature, the edge from out diameter of shroud extending slantingly to out diameter of hub plate where, so that the fluid could get larger curvature radius during outwards flowing from trailing edge by earlier turning. Separated whirl area by shroud plate to reduce disturbance between flow and impeller, so it could achieve the goal of reducing noise, increasing the outflow capacity and getting higher efficiency.

PRIOR TECHNICAL FIELD OF THE INVENTION

Regenerative pump is a popular device used in residential water pressure boost system. Owing to its small size and affordability to meet with the residential need of high water head and delivery capacity, for example, it can lift water from the ground to a water tank on roof, it also can pump water from a pond to the indoors, etc. Sometimes the pump is also equipped with a pressure switch and a pressure tank as a pressure boost pump. Although a regenerative pump is popular, it has some weaknesses, including loud noise, lower outflow capacity, and lower efficiency; those are often criticized by the users.

SUMMARY OF THE INVENTION

According to the disadvantages of prior art technique described above, the present invention has developed a brand new design to improve the structure of a flow channel of a regenerative pump.

The object of the present invention provides an improved structure of a cross section of the flow channel inside a pump casing (5). The maximum width (B3) of flow channel nearby the leading edge (32) of the vane (3*a*) is able to offer more space and keep the whirl area (77) moving to side space of impeller (3), and the shroud plate (34) can separate the whirl area (77) and vanes (3*a*), so it will no energy be work down the whirl flow by vanes (3*a*), the velocity at whirl area (77) will be slow down, the severe flowing disturbance is reduced.

Another object of the present invention provides an improved flow channel of impeller (3). Set a bigger thickness (t2) at vane root (30) and leading edge (32) than outer diameter of an impeller (3), so that the curves (32*a*) on vane root (30) and shroud curve (34*a*) at leading edge (32) will have more space to setup a smoothly axial inlet curve structure for flow channel, that will enlarge the curvature radius of the streamline at leading edge (32), the maximum width (B3) of cross section of flow channel be near the leading edge (32), this will offer more space to push the whirl area (77) located at side space of impeller (3), that will reduce the disturbance between impeller (3) and flow. A more object of the present invention provides an improved structure of an impeller (3). The hub plate (36) has the maximum outer diameter, the trailing edge (31) at out diameter of impeller (3) is a incline line, it is extension from the out diameter of shroud plate (34) slantingly to the out diameter of hub plate (36) where, so that the fluid could get larger curvature radius during outwards flowing from trailing edge (31) by earlier turning. Additionally, the pin point (35) will has obtuse angle to reduce the flowing disturbance with the whirl area (77).

DETAILED DESCRIPTION OF THE INVENTION

Figure 1:
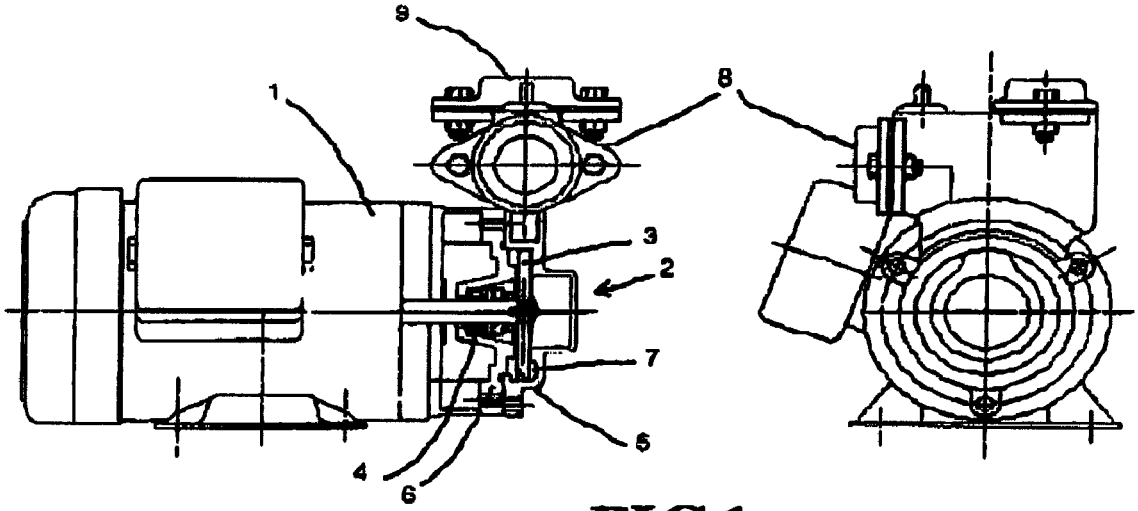
FIG. 1 is a structure of prior art technique for manufacturing a regenerative pump.

Referring to FIG. 1, the structure of a regenerative pump includes an inlet port (8) connecting with city water pipe or other water source pipe, an outlet port (9) discharge out the flow pressurized by the impeller (3); the body of a pump consists of a pump casing (5), a back cover (6), an impeller (3) and a seal (4). The axis of motor (1) passes through back cover (6) and seal (4) to drive impeller (3) directly. The impeller (3) is installed inside the housing between pump casing (5) and back cover (6). The flow channel (7) of pump casing is constructed by interior wall of the housing of casing (5), and the flow channel also constructed by the vanes profiles and the space between vanes (3*a*) of the impeller (3).

Figure 2:
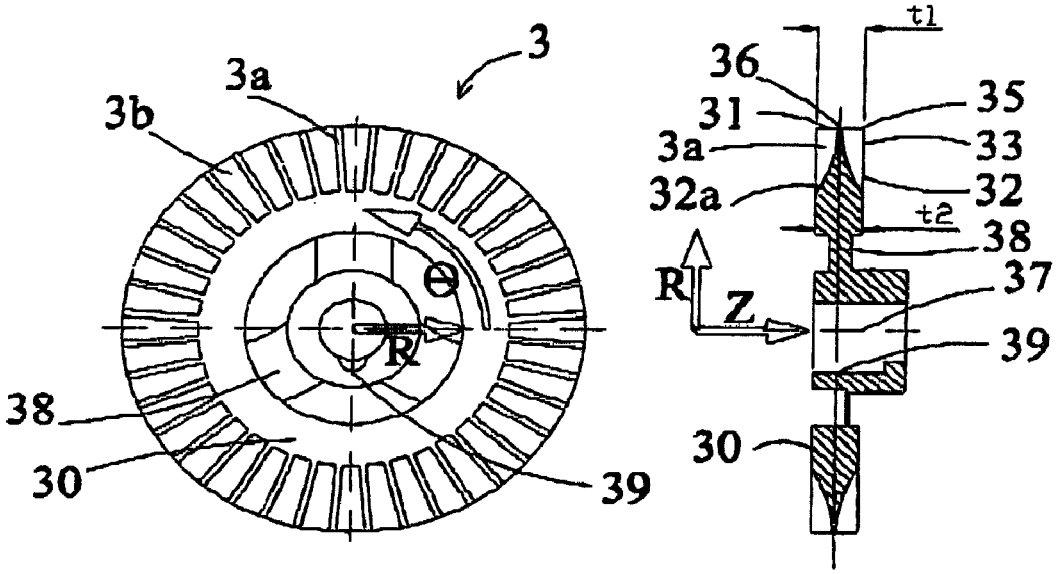
FIG. 2 is a structure of prior art technique for manufacturing the impeller of a regenerative pump.

Referring to FIG. 2, the structure of a regenerative impeller (3) from prior art technique is a circular plate and the whole one most is in an even thickness, the thickness (t2) of the vane root (30) and the thickness (t1) of the impeller (3) are same. There are plural radial vanes (3*a*) on the both sides or just on one side around the outer diameter of an impeller (3). The space between each adjacent vane (3*a*) establishes a radial flow channel (3*b*). The vane (3*a*) consists of the leading edge (32), the curve (32*a*) on the vane root, the vane root (30), the shroud edge (33), the trailing edge (31), and a hub plate (36) of the impeller (3). The hole (37) with a slot (39) on the hub of the impeller (3) is used to be driven by the axis of motor (1). There are plural ribs (38) to connect the hub with the vane root (30) of the impeller (3). As the structure of an impeller (3), the axial coordinate is z axis, the radial coordinate is r axis, and both the cross section of the radial flow channel (3*b*) and the cross section of the flow channel (7) inside pump casing are expressed by r-z coordinate.

Figure 3:
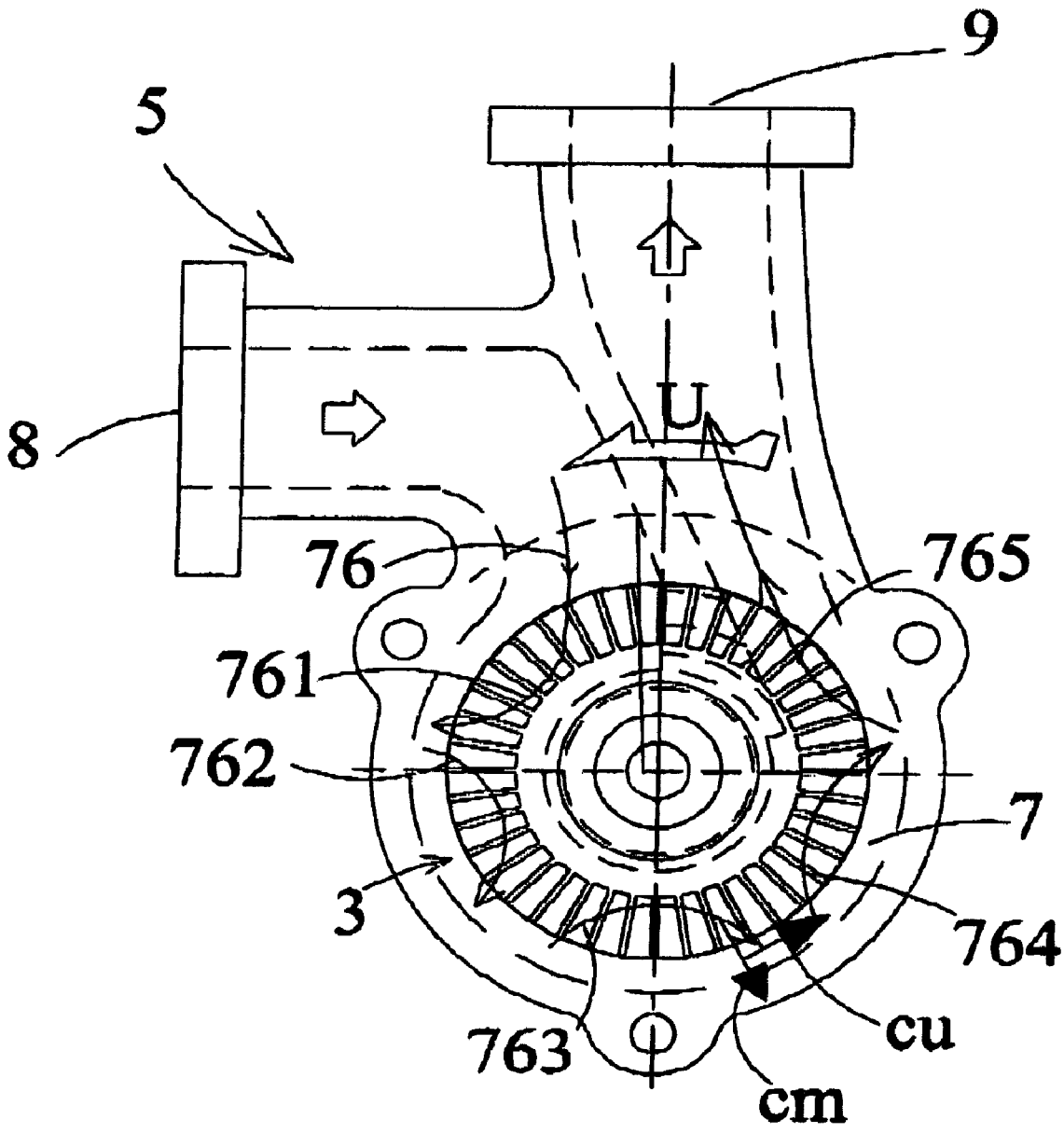
FIG. 3 is an enlarged view of the fluid in multi-times circulated process of a regenerative pump.
Figure 4A:
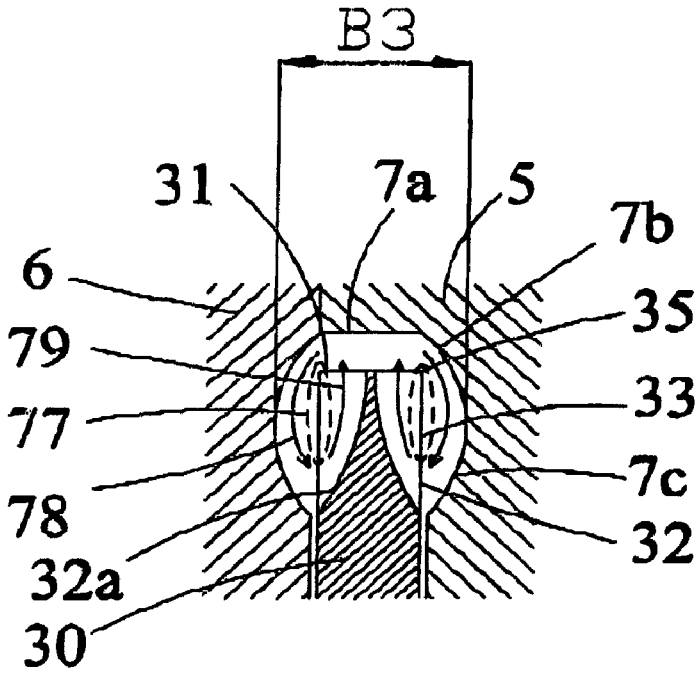
FIG. 4(A) is a cross section of the structure of the flow channel of a pump casing and the flow channel of an impeller for a prior art technique.
Figure 4B:
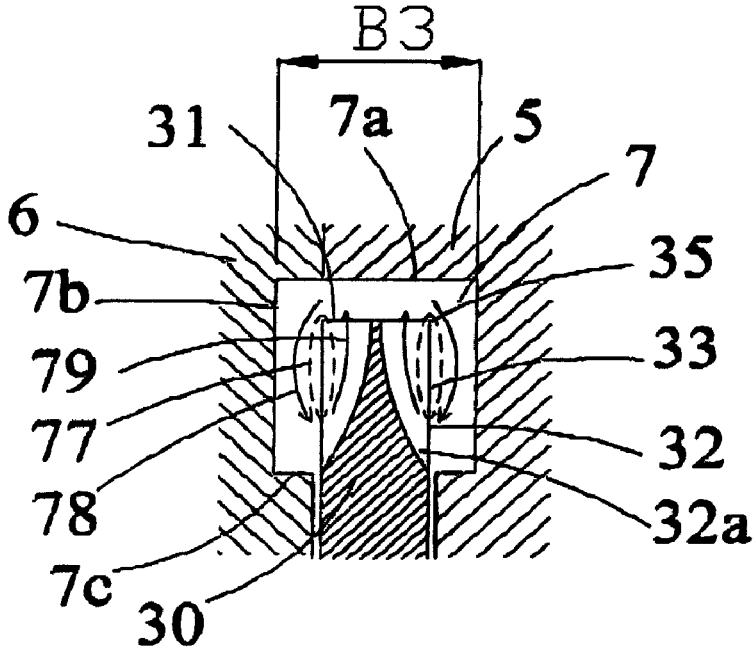
FIG. 4(B) is another cross section of the structure of the flow channel of a pump casing and the flow channel of an impeller for a prior art technique.
Figure 4C:
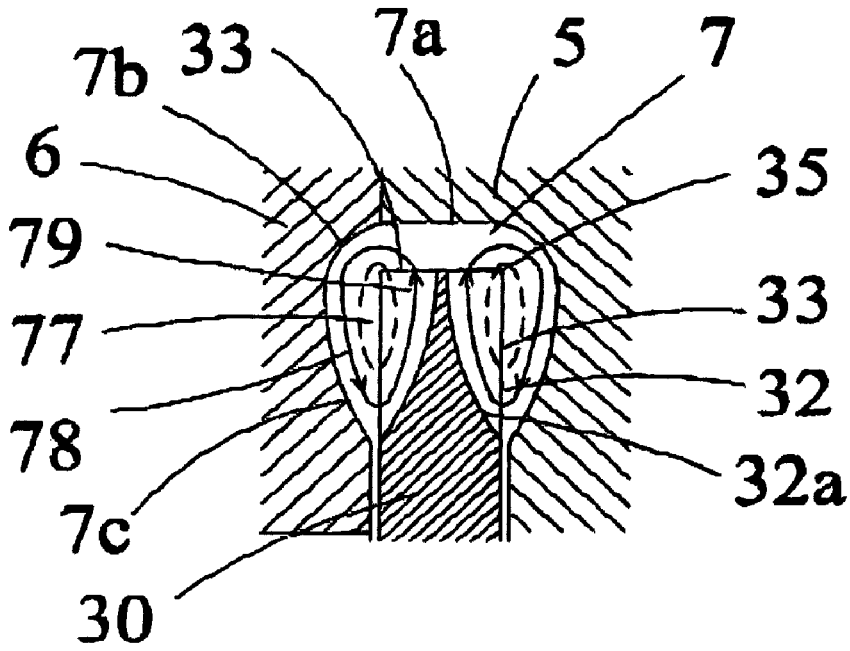
FIG. 4(C) is a further cross section of the structure of the flow channel of a pump casing and the flow channel of an impeller for a prior art technique.
Figure 4D:
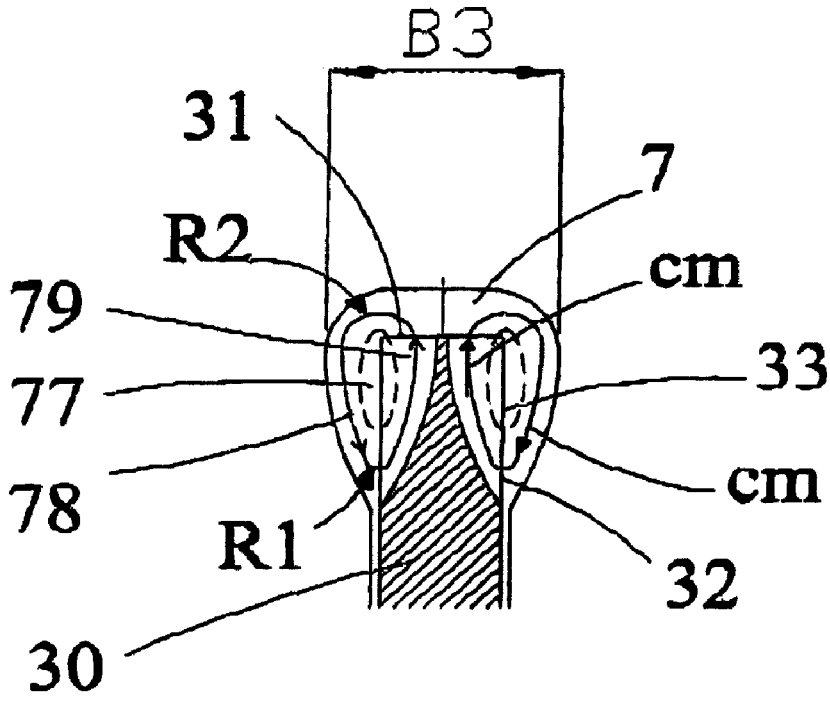
FIG. 4(D) is a flow model and streamlines inside a cross section of the structure of a flowing streamline of a flow channel for prior art technique.

Referring to FIG. 3, the energy in a regenerative pump is transferred through motor shaft to flow become a flow power, the mechanism is to rotate impeller (3) in a tangent velocity (u) and to intake the flow through the inlet port (8) to empower the fluid. The tracing of the flowing elements could be shown as the inlet streamline (76): This is the first energized cycle be transfer by the radial vane (3*a*) of an impeller (3), the inlet streamline (76) turns into the streamline (761) at leading edge (32) that earns a velocity (cm) in r-z coordinate, and get a tangent velocity (cu), same direction as tangent velocity (u) at tailing edge, the total quantity of these two velocities is the absolute velocity of fluid, and the tangent velocity (cu) is that the vane (3*a*) works down the fluid. After leaving from the trailing edge (31), the fluid is flowing into the flow channel (7) inside pump casing (5), and turn along by the interior wall of the flow channel (7) to enter the leading edge (32) of impeller (3) again, shown as the streamline (762), the tangent velocity (cu) is increased because of earning works through the vane (3*a*) again, but the velocity (cm) of r-z coordinate remains the same. The flow will repeat the same procedure of being energized by the vane (3*a*) several times before flowing out from the outlet port (9), shown as the streamline (763) and (764), and the streamline (765). After the fluid was energized by the vane (3*a*) several times, the flowing absolute velocity is approximate equal to the tangent velocity (u) of impeller, and the fluid has a higher static pressure; which is the reason why a regenerative pump could discharge a high head pressure. Also of the character of high head pressure, the similar mechanism is applied widely in the other fluid machinery also, for example: the ring blower.

FIG. 4 is a cross section of the flow channel (7) of a pump casing (5) of a conventional pump, and the flow model is shown by two streamlines, streamline (78) and streamline (79), flow channel inside pump casing (5) and flow channel between vanes of impeller, the cross section is basically a rectangle from prior art technique, and the flow model shown by velocity (cm) in r-z coordinate. In FIG. 4(A), a section of a flow channel (7) inside pump casing (5) is a rectangle with curve shape of interior wall, the interior wall of a cross section of flow channel has the top wall (7*a*), the side wall (7*b*), the bottom wall (7*c*), and has a maximum width (B3); the maximum width (B3) is the width between both side walls (7*b*) and located at middle of the side wall (7*c*). In FIG. 4(B), it shows that the rectangle cross section keep same widths (B3), the flow channel also has the top wall (7*a*), the side wall (7*b*), and the bottom wall (7*c*). If the cross section is basically a rectangle as FIG. 4(A) and FIG. 4(B), the width at top wall (7*a*) of the flow channel has not enough space for flow to make turning as from streamline (79) to streamline (78) or from streamline (78) to streamline (79), and the flow streamlines will be limited in small curvature radius, the flow model shown as in FIG. 4(A) and FIG. 4(B). Here has more detail descriptions, when the fluid is flowing out from the trailing edge (31) from vanes flow channel (3*b*), the streamline (79) has to make a turning angle near 180°, from the interior top wall (7*a*) then turn towards the side wall (7*b*), shown as the streamline (78). Owing to space litation, the streamline curvature radius (R2) at the trailing edge becomes very small, so the fluid needed to make a sharp U turn. Besides, the pine point (35) is located on the corner where the streamline (79) must be turning round, it get a results in highly disturbance between shroud edge (33) of vanes (3*a*) and flow; that is a highly turbulence flow and high level noise. There has similar condition for streamline (78), the flow along the side wall (7*b*) forwards to the leading edge (32), streamline (78) needed to make a sharp U turn to turn into leading edge (32) and to connect streamline (79), owing to not enough space also. Additionally, the curve (32*a*) on vane root (30) near the leading edge, the flow channel makes a severe radial turning towards the outer diameter, and this is not helpful for keeping streamlines in smoothly, and makes a very small curvature radius (R1) at the leading edge (32). At the central part of flow model, between streamline (79) and streamline (78), form a whirl area (77) in long and narrow shape. The whirl area (77) in oval, occupy some space on such narrow flow channel (7) inside pump casing (5), and also disturb between shroud edge (33) of vanes (3*a*) and flow, cause a highly turbulence flowing in there and make high noise also. In order to solve the problems described above, to widen the maximum sectional width (B3) of the flow channel (7) of a pump casing (5) is one of good ways. Shown in FIG. 4(C), there are top wall (7*a*), side wall (7*b*), bottom wall (7*c*), and the maximum sectional width (B3) is located near the trailing edge (31), so the top wall (7*a*) and the side wall (7*b*) form a curve with bigger curvature radius. The result illustrated in FIG. 4(C) and FIG. 4(D), when fluid following the streamline (79) flowing out the trailing edge (31), it will gets a bigger curvature radius (R2) at the trailing edge (31) by the big-curved interior wall of the flow channel near top wall (7*a*). But the width at the bottom wall (7*c*) is same as the thickness (t2) of the vane root (30), it is smaller than the maximum width (B3), and the curve (32*a*) on vane root near the leading edge (32) form a sharp angle, which causes the turning from streamline (78) to streamline (79) become a very sharp U turn, compared with FIG. 4(A), FIG. 4(B) and FIG. 4(C) get a very smaller curvature radius (R1) of a streamline at the leading edge, it is bad for the fluid making smooth flowing towards the leading edge (32). Shown in FIG. 4(C) and FIG. 4(D), the whirl area (77) is slightly moving upward to the top wall (7*a*) and the side wall (7*b*), and achieves a result that partial whirl area (77) moves out from the shroud edge (33); it could reduce the disturbance between the flow and the vanes (3*a*) but the noise still high, some is owing to the pine point (35) still interference with the whirl area (77), it still get a results in highly disturbance between vanes (3*a*) and flow, and the leading edge (32) of vanes (3*a*) is still not enough space where the streamline (79) must be turning a sharp U turn; that is a highly turbulence flow and high level noise. Therefore, if only widen the maximum sectional width (B3) near the trailing edge (31), it only can get an improvement on the partial, but still cannot solve the problem of loud noise and low efficiency.

The following description focuses on prior art technique about the phenomenon of severe flowing disturbance between the vanes (3*a*) and flowing fluid. As illustrated in FIG. 2, the whole impeller (3) is in an even thickness, the thickness (t2) of the vane root (30) and the thickness (t1) of outer diameter of an impeller (3) at the tailing edge (31) are same, shroud edge (33) and leading edge (32) form in a radial straight line. As shown in FIG. 4(*d*), this design the vane (3*a*) could offer large energy to push the fluid circular flow inside the flow channel (7) by highly disturbance between vanes (3*a*) and fluid, especially work down on the whirl area (77),so that the fluid inside the whirl area (77) is flowing in a tangent velocity (cu) approximate to the tangent velocity (u) of impeller (3), so the outflow can get higher head pressure, the whirl area (77) occupied more space on the flow channel (7) inside pump casing (5)and block some space of the radial flow channel (3*b*) of the vane (3*a*) also, it not only makes a disturb between shroud edge (33) and flow, also reduce outflow capacity, and performance is loud noise and low efficiency. Therefore, a cross section of the flow channel (7) inside pump casing needed more precision design to avoid the whirl area (77) block the flow channel to keep capacity up; the curve (32*a*) on vanes root (30) near leading edge (32) is needed design also, to improve the sharp U turn and smallest curvature radius (R1) condition at the leading edge; and the condition at trailing edge not only improve small curvature radius (R2), but also make the pin point (35) has a obtuse angle, and use shroud plate (34) to reduce the disturbance between shroud edge (33) and flow; those requires above are the issues for the new structure of flow channel for a new regenerative pump in less noise and higher flow rate.

The regenerative pump is popular used in residential water system and many industrial applications. Besides the methods described above, there are many ways were addressed successively to solve the problem above, the examples as the following:

Amend the structure or space size of an inlet port (8) flow channel of a pump to improve the inlet streamline (76) from the inlet port (8), shown in U.S. Pat. No. 4,498,124A1, JP11173290A, JP2005180382A, and U.S. Pat. No. 6,336,788B1.

Amend the structure of space size of an outlet port (9) flow channel of a pump to improve the exporting streamline (765), shown in U.S. Pat. Nos. 6,336,788B1, 6,974,301B2, and 4,498,124A1.

Amend the sectional width of the flow channel of a pump casing (5), for example: a round section of a flow channel or a widen rectangle section of a flow channel, be shown in JP612102888A, JP2005180382A, and US2002054814A1.

Amend the structure of impeller vanes (3*a*) in stagger arrangement for reduce vibration, shown in U.S. Pat. No. 6,296,439B1.

From prior art technique described above, some solutions were addressed successively for the regenerative pump for purpose, but there still are some disadvantages as the following:

1. The open type impeller (3) with radial, or curve vane (3*a*), or vane (3*a*) in stagger arrangement, the shroud edge (33) directly work down the whirl area still has highly disturbance between vanes (3*a*) and flow.
2. The pine point (35) has right angle located near center part of whirl area (77) of cross section of the flow channel, that will have highly turbulent flow affects the pump function badly and makes noise.
3. The flow model of the cross section of the flow channel, small curvature radius, R1 & R2 of a streamline still existing at the leading edge (32) and the trailing edge (31) affect the pump function badly and make noise.

The present invention is to solve the problems described above and developed a more effective solution to make the regenerative pump to meet the needs. As illustrated as the following description, the present invention is further to explain the features, purpose and function.

Figure 5:
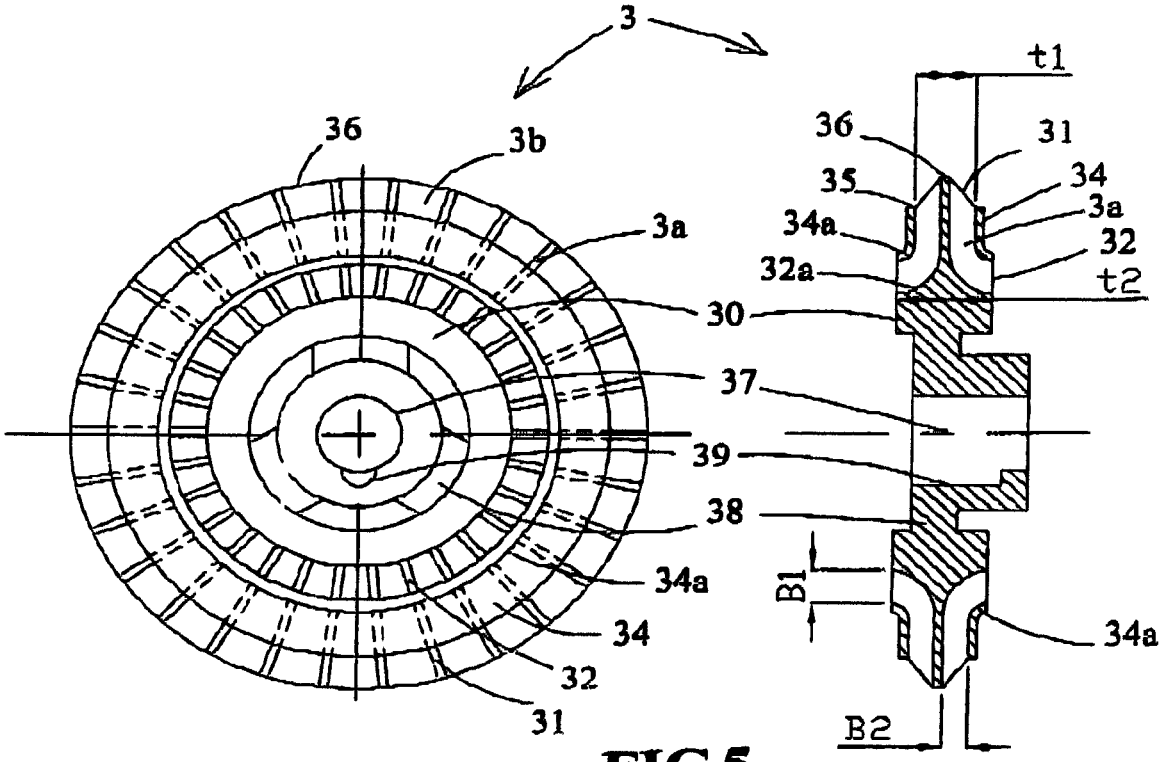
FIG. 5 is a cross section of the structure of a regenerative pump of the present invention.

FIG. 5 is a sectional view of a closed impeller (3) of the present invention. The structure of an impeller (3) is a circular plate. There are plural radial vanes (3*a*) on both sides of outer diameter of an impeller (3). The space between each adjacent vane establishes a radial flow channel (3*b*). The vane (3*a*) consists of the leading edge (32), the shroud plate (34), the trailing edge (31), and the hub plate (36). The impeller (3) driven by axis of a motor (1) is through the hole (37) of the hub with a slot (39). There are plural ribs (38) to connect the hub and vane root (30). As the structure of an impeller (3), the axial coordinate is z axis, the radial coordinate is r axis, and both cross section of the radial flow channel (3*b*) and the flow channel (7) inside pump casing are expressed by r-z coordinate. The thickness of an impeller includes the thickness (t1) of the outer diameter of a circular plate and the thickness (t2) of the vane root (30). The vane root (30) has bigger thickness (t2) to provide the unique curve (32*a*) near the leading edge (32) and keep the inlet of vanes (3*a*) with axial curve structure. This design can improve greatly the curvature radius (R1) of a streamline at the leading edge (32), shown in FIG. 4. The outer diameter of a hub plate (36) of vane (3*a*) is larger than the outer diameter of shroud plate (34), the trailing edge (31) is an incline line extension from the out diameter of shroud plate (34) to hub plate (36) outer diameter, and the pine point (35) has an obtuse angle. Both the shroud plate (34) and the leading edge (32) have a axial curve structure to enhance the smoothly flowing at the inlet part of vanes (3*a*), and to constrain the whirl area (77) at side space of shroud plate to separate the whirl area (77) and the vanes (3*a*) to reduce flowing disturbance to the least. And, the velocity (cm), based on r-z coordinate, are similar equal at the width (B1) on the leading edge and the width (B2) on the trailing edge.

Figure 6A:
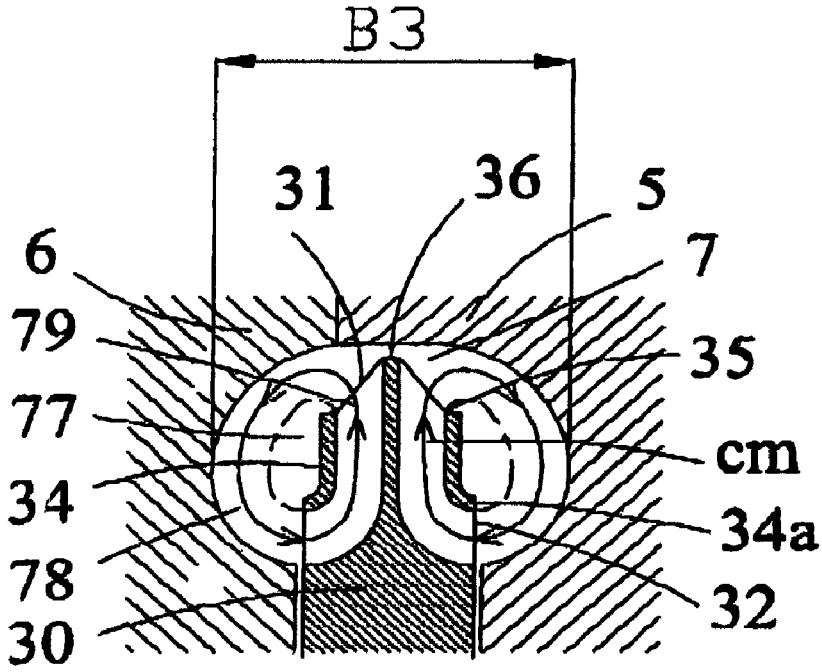
FIG. 6(A) is a cross section of the structure of a regenerative impeller and the flow channel of a pump casing of the present invention.
Figure 6B:
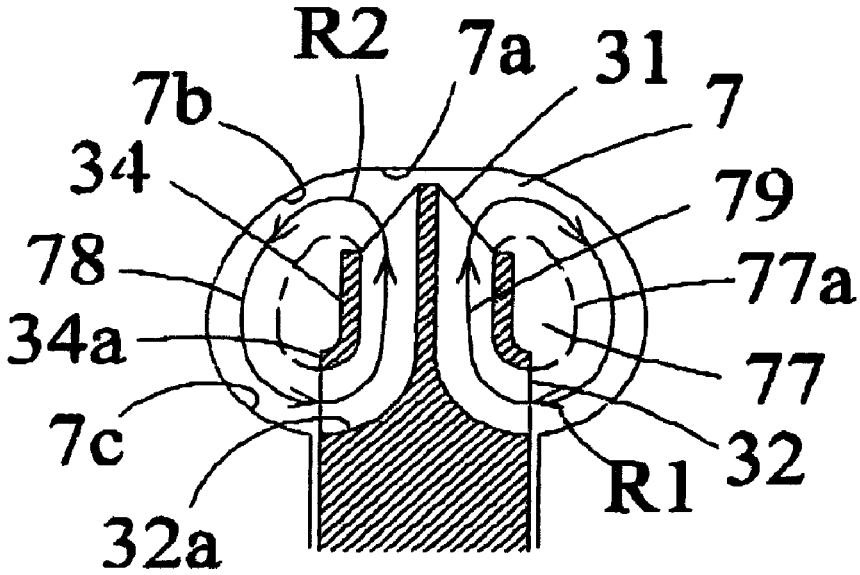
FIG. 6(B) is a flowing streamline inside a cross section of the structure of a flow channel of the present invention.

FIG. 6 is a cross section of the flow channel inside pump casing (5) of the present invention. FIG. 6(A) is showing a flow model formed by streamline (78) and streamline (79) with a velocity (cm) of r-z coordinate inside the flow channel. FIG. 6(B) is a further explanation about the flow model in pump casing (5). The character of my invention is innovative of the flow model include flow channel inside pump casing (5) and flow channel in the vanes (3*a*) of closed type impeller (3). The maximum sectional width (B3) of the flow channel (7) inside pump casing (5) is close to the leading edge (32), so that the bottom wall (7*c*) is able to provide enough space both for the whirl area (77) and the leading edge (32); and ensures that the streamline (78) and the streamline (79) are smoothly at the leading edge (32) and have a better curvature radius (R1). Additionally, the bottom wall (7*c*) and the axial inlet of the curve (32*a*) at leading edge, also on vane root, to form a smooth continuously interior wall curve; the shroud plate (34) also has the axial inlet of the curve (32*a*) at leading edge. The shroud plat (34) is able to separate vanes (3*a*) and flow area (77), and reduce flowing disturbance caused by the whirl area (77) and the vane (3*a*) interference, and keeps the whirl area (77) stay at the central area of the flow model, so that the whirl area (77) will not occupy space on the streamline (78) and streamline (79).

The trailing edge (31) is close to the interior top wall (7*a*) and is extending slantingly to a hub plate (36) where has the maximum outer diameter, the partial fluid is able to make a earlier turn from trailing edge (31), by shroud plat (34) side, towards streamline (78), and the angle formed by the top wall (7*a*) and the side wall (7*b*) is an obtuse angle, so that there is a best curvature radius (R2) for outwards flow from trailing edge (31). Besides, the pin point (35) has an obtuse angle; it could reduce the flowing disturbance, so that the streamline (79) will not make a sharp U turn into streamline (78) and has the best curvature radius (R2).

The streamline (78) flows along the interior side wall (7*b*) toward bottom wall (7*c*), it will passes through the maximum sectional width (B3), then along the bottom wall (7*c*) to make a getting turning to enter the leading edge (32). In other words, the maximum width (B3) is helpful to enlarge the space between the side wall (7*b*) and the shroud plate (34) to accept the whirl area (77). The curve (32*a*) on the van root (35) has an axial inlet curve that provides the streamline (78) smoothly flow along the bottom wall (7*c*). Therefore, the fluid has enough space to keep a best curvature radius (R1) when it is flowing to the leading edge (32). Besides, the shroud plate (34) also has the axis inlet curve (34*a*), similar the curve (32*a*) on vane root (30), therefore, when the streamline (78) is turning towards the leading edge (32), the curve (34*a*) on shroud plate (34) is contributive to separate the whirl area (77) from disturbing the streamline (79) and the streamline (78), so the streamline (79) has a short axial smoothly flow inlet part of leading edge (32), and then turning from axial to radial direction to flow out from the trailing edge (31).

A whirl area (77) in oval is located at the central part of the flow model, the flow model is formed by streamline (78) and streamline (79), and the whirl area (77) is located on space between streamline (78) and shroud plate (34); The whirl area (77) has a free boundary layer (77*a*) between streamline (78), and the free boundary layer (77*a*) eventually connects to the curve (34*a*) on the shroud plate. In other words, the whirl area (77) is controlled in whirl space, so the fluid of the whirl area (77) is driven by the smooth shroud plate (34) in a tangent velocity (u) of impeller, the whirl area (77) has a lower tangent velocity (cu).The vane of an open impeller does work down the whirl area (77) directly, so a tangent velocity (cu) of flowing fluid of the whirl area (77) is approximate to a tangent velocity (u) of an impeller (3). It means that the whirl area (77) of the closed impeller (3) will not have a severe whirl flowing and the flowing disturbance caused by the fluid and the vane (3*a*) is reduced greatly.

The structure of a flow channel of the present invention has the advantages of lower noise and high outflow volume. The descriptions of their characters are as following:

1. In the present invention, the streamline at leading edge (32) has a bigger curvature radius (R2): a section of the flow channel (7) of a pump casing (5) has the maximum width (B3) near at the leading edge (320, the vane root (30) of an impeller (3) has bigger thickness (t2) enough for the curve (32*a*) on the vane root (30) having axial structure to ensure that the fluid has the best curvature radius (R2) while flowing into the leading edge (32).

2. In the present invention, the streamline at trailing edge (31) has a bigger curvature radius (R2): a trailing edge (31) is extending slantingly to a hub plate (36) where has the maximum outer diameter, partial fluid is able to make a turn in advance from a shroud plat (34) towards the top wall (7*a*) and then the side wall (7*b*), and the pin point (35) has an obtuse angle, so streamline has the best curvature radius (R2).

3. In the present invention, the closed type impeller (3) does not cause severe flowing disturbance with the whirl area (77): the shroud plate (34) of impeller (3) is able to separate the whirl area (77) and vanes (3*a*), and the maximum sectional width (3B) of flow channel near the leading edge (32) that has enough space to keep the whirl area (77) stay on the side space of impeller (3), to reduce disturbance caused by the whirl area (77) and the impeller (3).

Conclusion of above descriptions, the present invention obviously possesses the above efficiencies and practical values, and can promote the benefit of economic values, so the present invention is an excellent innovation indeed. There is no same or similar product in this technical field has used in public, so the present invention is qualified for a claim for applying the patent. The above descriptions just only are practical examples of the present invention that could not be a limit to the filed of my invention. Whatever an adaptation, an alternation or a modification as long as bases on the patent field of the present invention and still retains the essence of the present invention or not beyond the spirit and the field of the present invention substantially should be viewed as the further practical situation of the present invention.

DESCRIPTION OF THE SYMBOLS FOR THE ELEMENTS IN THE DRAWING

| | |
|---|---|
| B1: | the width of a flow channel at a leading edge |
| B2: | the width of a flow channel at a trailing edge |
| B3: | the maximum sectional width of a flow channel inside a pump casing |
| cm: | the velocity of flowing fluids inside the cross section of flow channel in r-z coordinate |
| cu: | the tangent velocity of flowing fluid inside the flow channel |
| R1: | the curvature radius of a streamline at the leading edge |
| R2: | the curvature radius of a streamline at the trailing edge |
| r: | the radial coordinate |
| z: | the axial coordinate |
| t1: | the thickness of an impeller at out diameter |
| t2: | the thickness of an impeller at vane root |
| u: | the tangent velocity of an impeller |
| 1: | the motor |
| 2: | the regenerative pump |
| 3: | the impeller |
| 3a: | the vane |
| 3b: | the radial flow channel |
| 30: | the vane root |
| 31: | the trailing edge |
| 32: | the leading edge |
| 32a: | the curve on vane root at the leading edge |
| 33: | the shroud edge |
| 34: | the shroud plate |
| 34a: | the curve on shroud plate at the leading edge |
| 35: | the pin point on trailing edge |
| 36: | the hub plate of impeller |
| 37: | the hole of the hub of the impeller |
| 38: | the ribs |
| 39: | the slot |
| 4: | the seal |
| 5: | the pump casing |
| 6: | the back cover of a pump casing |
| 7: | he flow channel inside pump casing |
| 7a: | the top wall of flow channel |
| 7b: | the side wall of flow channel |
| 7c: | the bottom wall of flow channel |
| 76: | the inlet streamline |
| 761: | the re-circulate streamline |
| 762: | the re-circulate streamline |
| 763: | the re-circulate streamline |
| 764: | the re-circulate streamline |
| 765: | the outlet streamline |
| 77: | the whirl area |
| 77a: | the free boundary layer |
| 78: | the streamline inside pump casing |
| 79: | the streamline inside vanes |
| 8: | the inlet port |
| 9: | the outlet port |

What is claimed is:

1. A flow channel structure of a regenerative pump, comprising:

an impeller flow channel of an impeller, said impeller comprising a plurality of radial vanes on both sides at an outer diameter thereof, a radial flow channel defined between each adjacent vane, a shroud plate, an axial curve on a vane root at a leading edge of the impeller to form an axial inlet, a hub plate to support the radial vanes at both sides of the impeller, and a trailing edge at an outlet of the impeller flow channel;

a pump casing flow channel inside a pump casing, said pump casing comprising a top wall, a side wall and a bottom wall, wherein a cross section of said pump casing flow channel is defined by an interior of the top wall, the side wall, the bottom wall, wherein a maximum width section of said pump casing flow channel is adjacent to the leading edge, said top wall being adjacent to the trailing edge, wherein an inner diameter of the top wall is greater than an outer diameter of the trailing edge, the top wall and the side wall forming an obtuse angle, and the side wall extending slantingly to the maximum width section and said side wall being connected with the bottom wall, the bottom wall turning to the leading edge while passing the maximum width section, wherein the bottom wall and the axial curve on the vane root form a smooth connection and form a smooth inlet at the leading edge.

2. The flow channel structure of a regenerative pump as claimed in claim 1, wherein the shroud plate of the impeller includes the axial curve at the leading edge to form the axial inlet.

3. The flow channel structure of a regenerative pump as claimed in claim 1, wherein the hub plate of the impeller has a maximum outer diameter, the trailing edge extending slantingly from an outer diameter of the shroud plate to the maximum outer diameter of the hub plate.

4. The flow channel structure of a regenerative pump as claimed in claim 1, wherein a thickness of the vane root is greater than a thickness of the outer diameter of the impeller.

5. The flow channel structure of a regenerative pump as claimed in claim 1, wherein one or more of the impeller flow channel and the pump casing flow channel is used to pump a fluid, said fluid including gas or liquid.

6. A flow channel structure of a regenerative pump, comprising:

a flow channel of an impeller, said impeller having a plurality of radial vanes on both sides at an outer diameter thereof, a radial flow channel between each adjacent vane, a shroud plate, a hub plate to support the vanes at both sides of the impeller, a leading edge and a trailing edge at an outlet of the flow channel of the impeller, wherein a thickness of a vane root is greater than a thickness of the outer diameter of the impeller, the vane root having an axial length curve at said leading edge to form an extensively axial inlet of impeller.

7. The flow channel structure of a regenerative pump as claimed in claim 6, wherein the hub plate of the impeller has a maximum outer diameter, the trailing edge extending slantingly from an outer diameter of the shroud plate to the maximum outer diameter of the hub plate.

8. A flow channel structure of a regenerative pump, comprising:

a flow channel inside a pump casing, said pump casing comprising a top wall, a side wall and a bottom wall, said flow channel having a cross section defined by at least an interior of said top wall, said side wall and said bottom wall, wherein a maximum width section of said flow channel is adjacent to the leading edge of an impeller, and the top wall is adjacent to a trailing edge of an impeller, said top wall having an inner diameter that is greater than an outer diameter of the trailing edge, the top wall and the side wall forming an obtuse angle, and the side wall extending slantingly to the maximum width section and around said maximum width section to connect with the bottom wall, the bottom wall turning to the leading edge while passing the maximum width section, wherein the bottom wall and a curve on a vane root of the impeller form a smooth connection and form a smooth inlet at the leading edge.

* * * * *